United States Patent [19]

Netta

[11] 3,983,911

[45] Oct. 5, 1976

[54] TOOL JAWS

[75] Inventor: Louis A. Netta, North Brunswick, N.J.

[73] Assignee: Thomas & Betts Corporation, Elizabeth, N.J.

[22] Filed: Oct. 17, 1975

[21] Appl. No.: 623,432

[52] U.S. Cl. ..... 140/93 A; 140/93.2

[51] Int. Cl.[2] ..... B21F 9/02

[58] Field of Search ..... 140/57, 93 A, 93.2, 140/123.6; 81/329

[56] References Cited

UNITED STATES PATENTS

| | | | |
|---|---|---|---|
| 3,368,590 | 2/1968 | Welden | 140/93 |
| 3,633,633 | 1/1972 | Countryman | 140/93.2 |
| 3,891,012 | 6/1975 | Bakermans | 140/93 |
| 3,946,769 | 3/1976 | Caveney et al. | 140/93.2 |

*Primary Examiner*—Lowell A. Larson
*Attorney, Agent, or Firm*—David Teschner; Jesse Woldman

[57] ABSTRACT

The resiliently biased movable tool jaw in, for example, a strap applying tool is maintained in closed contact with the other jaw of the tool against a counteracting force during a critical phase of the tool cycle by the selective deployment of a lock pin engageable with the movable jaw and which is operatively coupled to an actuator cooperative with a reciprocating plunger employed to drive the movable tool jaw into its closed position. Movement of the lock pin is synchronized with the movement of the plunger to insure correspondence between the relative positions of the lock pin and the movable jaw.

10 Claims, 11 Drawing Figures

TOOL JAWS

BACKGROUND OF THE INVENTION

1. Field of the Invention

The invention is directed to the field of locking means for tool jaws and the like.

2. Description of the Prior Art

In U.S. Pat. No. 3,810,498 issued May 14, 1974 to L. Hidassy and assigned to the assignee of the instant invention, there is shown a pair of tool jaws for a strap applying tool, one of the jaws being resiliently biased to prevent its full closure against the opposing jaw in the event an obstruction is encountered during this particular phase of the tool cycle. However, after the jaws have been operated to their fully closed position, a counteracting force on the movable jaw may operate to cause the jaws to separate, which condition may lead to a malfunction of the tool or a misapplication of the strap during the strap applying phase of the tool cycle.

A similar condition may exist in other tools designed for either a similar or a diverse application and which rely on the maintenance of the tool jaws in a closed state during a critical phase of the operating cycle.

SUMMARY OF THE INVENTION

The invention is directed to a locking means for maintaining the tool jaws of a strap applying tool or the like in a fully closed state during a critical phase of the tool cycle to overcome the difficulties and limitations noted above with respect to prior art devices. The locking means comprises a lock pin operatively coupled to an actuator seated within the path of a reciprocating plunger employed to operate the tool jaws from an open to a closed position. A slotted aperture is provided in the tool frame so that the lock pin may be deployed from a first position adjacent the movable one of the tool jaws to a second position overlying the movable tool jaw after the tool jaw has been operated to its closed position to maintain the tool jaw in the desired position against a counteracting force which may tend to open the jaws during the strap applying phase of the tool cycle. The lock pin may comprise an extending straightened portion of a torsion spring which is disposed about a support post located on the tool frame. The other end of the spring is attached to the actuator which is pivotingly mounted to the tool frame for engagement with the tool plunger as the plunger advances through its forward stroke. The slotted aperture is provided with an inclined camming surface adapted to guide the lock pin into engagement with the movable jaw and to provide a bearing surface against which the lock pin may be supported to insure that the pin remains seated against the movable jaw in the event a counteracting force is applied to the jaw. It is therefore an object of this invention to provide improved tool jaws for a strap applying tool or the like.

It is another object of this invention to provide a jaw locking means for a strap applying tool or the like.

It is a further object of this invention to provide a jaw locking means movably synchronized to a jaw actuating means in a strap applying tool or the like to insure that the tool jaws remain closed during a designated phase of the tool cycle.

It is still another object of this invention to provide a means for rendering inoperative the biasing means associated with a tool jaw of a strap applying tool during a designated phase of the tool cycle.

Other objects and features will be pointed out in the following description and claims and illustrated in the accompanying drawings which disclose, by way of example, the principle of the invention and the best mode contemplated for carrying it out.

IN THE DRAWINGS

Similar elements are given similar reference characters in each of the respective drawings.

DESCRIPTION OF THE PREFERRED EMBODIMENTS

Figure 1:
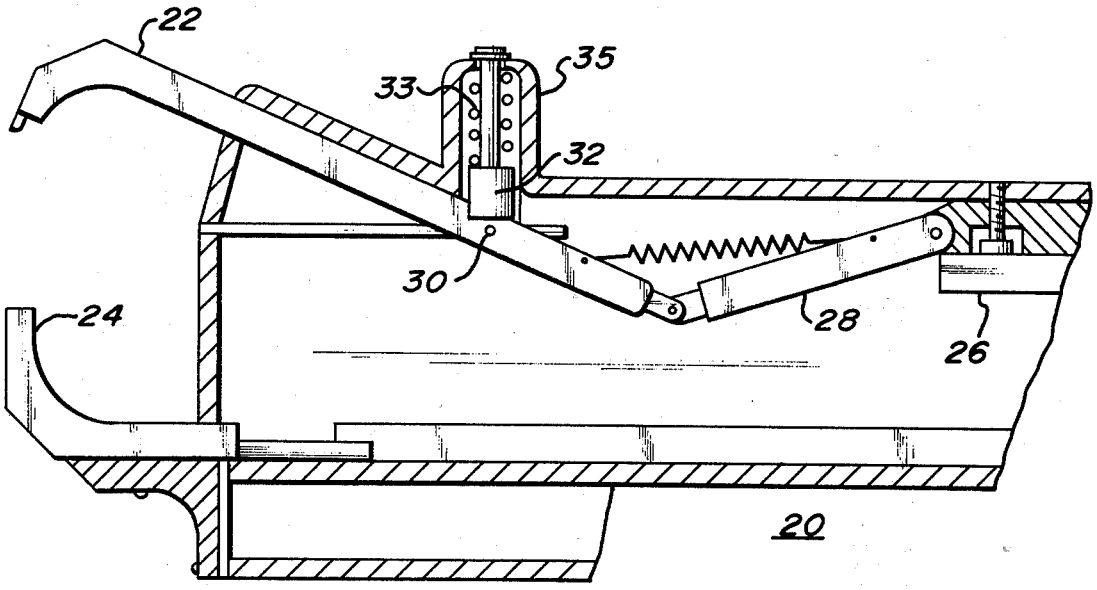
PRIOR ART FIG. 1
FIG. 1 is a fragmentary side elevational view, partly in section, of a prior art tool jaw construction.

Turning now to FIG. 1, there is shown the nose portion 20 of a prior art strap applying tool comprising a movable jaw 22 and a stationary jaw 24. The movable jaw 22 is operated by a reciprocating plunge 26 which is caused to advance towards the left, as viewed in FIG. 1, during the operative portion of the tool cycle, to activate the articulated assembly consisting of the movable jaw 22 and a further member 28 hingedly joined thereto. The details of this operation are fully disclosed in the above mentioned patent and will not be repeated herein. The movable jaw 22 is pivotingly coupled to the frame of the nose portion 20 of the tool via a floating hinge pin 30 above which is positioned a resiliently biased plunger 32 held against the jaw 22 by a spring 33 located in a housing 35. The plunger and spring combination, 32 and 34, respectively, operate to prevent the plunger 26 from being detained in its stroke or exerting a damaging force on the jaw 22 in the event an obstruction exists between the jaws 22 and 24 preventing the jaw 22 from being driven to its fully closed position. In such event, the pin 30 is displaced upwardly against the spring biased plunger 32 as the plunger 26 advances in the operative stroke, permitting the entire jaw 22 to be driven safely upwardly and out of the path of the plunger 26 to relieve the pressure which may otherwise be exerted on the jaw 22 and the plunger 26. However, in the event no obstruction is encountered and the movable jaw 22 is driven to its fully closed position in engagement with the lower jaw 24, it is subjected to being reopened by a counteracting force inadvertently applied between the jaws 22 and 24 before the strap applying cycle is completed, thereby causing a possible misapplication of the strap (not shown) and malfunction of the tool.

Figure 3:
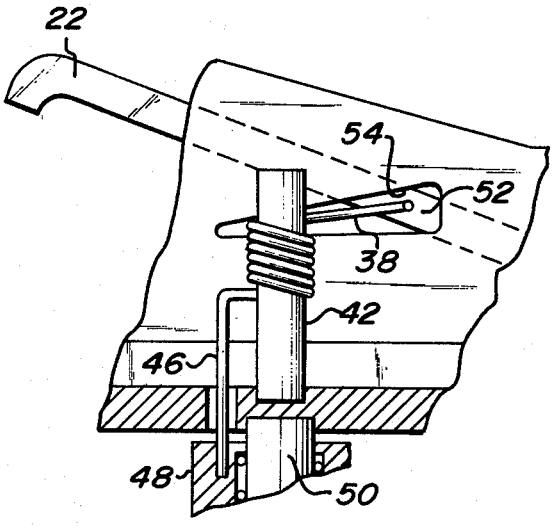
FIG. 3 is a fragmentary side elevational view, partly in section, showing further details of the device of FIG. 2.
Figure 4:
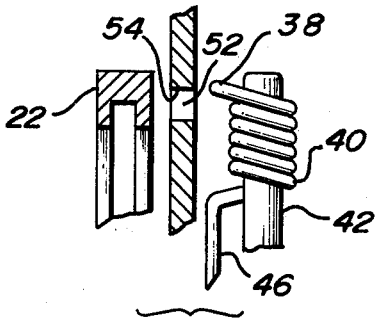
FIG. 4 is a fragmentary front elevational view, partly in section, of a portion of the device of FIG. 2.
Figure 2:
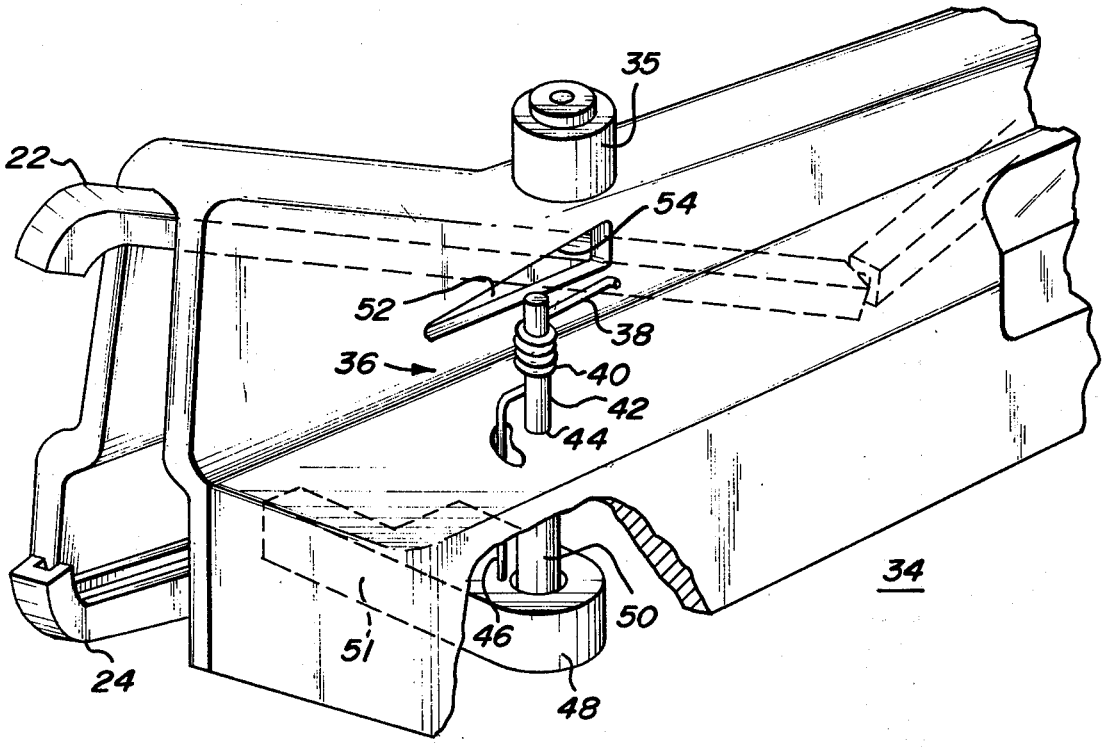
FIG. 2 is a fragmentary perspective view, partly cut away and partly in section, showing a tool jaw locking means constructed in accordance with the concepts of the invention.
Figure 5:
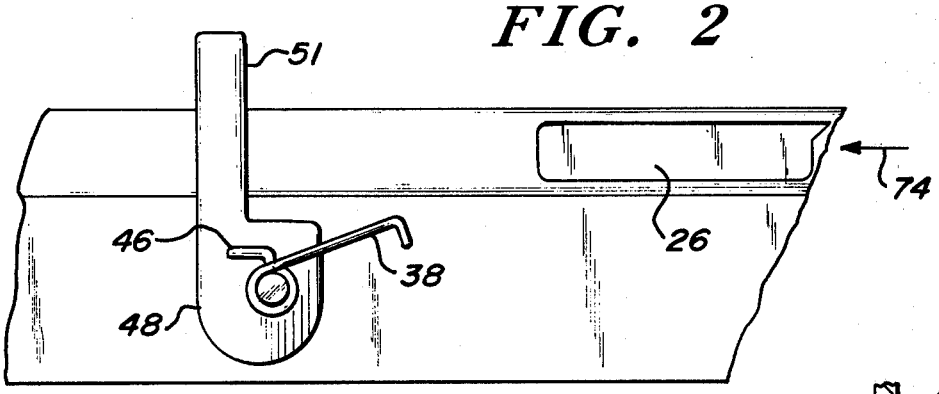
FIG. 5 is a fragmentary top plan view showing further details of the device of FIG. 2.
Figure 6:
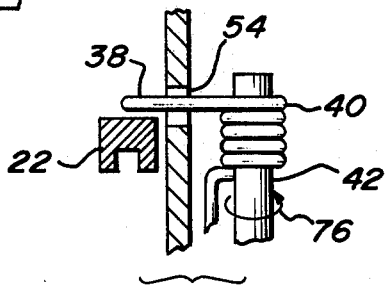
FIG. 6 is a fragmentary front elevational view, partly in section, of the locking means of FIG. 2 in the operated condition.
Figure 7:
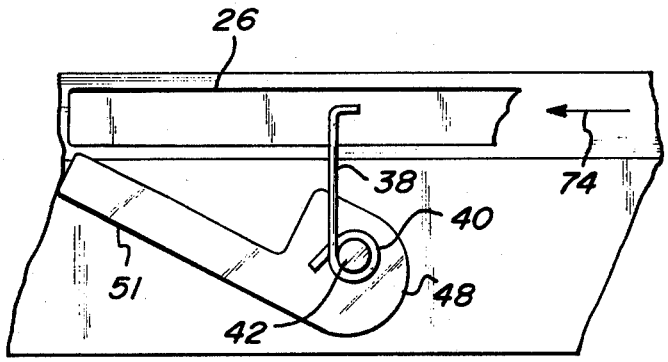
FIG. 7 is a fragmentary top plan view, similar to FIG. 5, showing the locking means of FIG. 2 in the operated condition.
Figure 8:
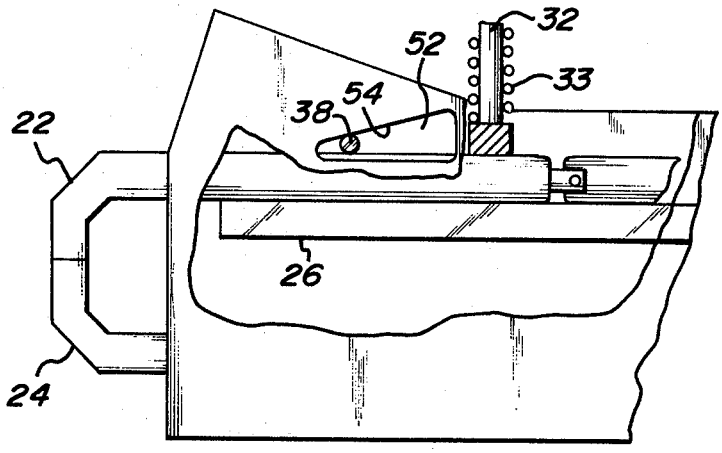
FIG. 8 is a fragmentary side elevational view, partly in section, showing the position of the locking means of the present invention in the lock condition relative to a tool jaw.
Figure 9:
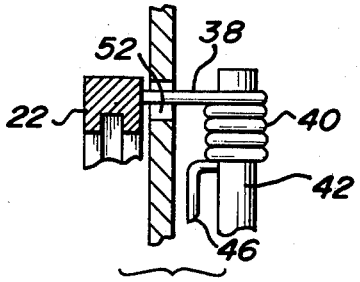
FIG. 9 is a fragmentary front elevational view, partly in section, showing the locking means of the present invention in an intermediate position.
Figure 10:
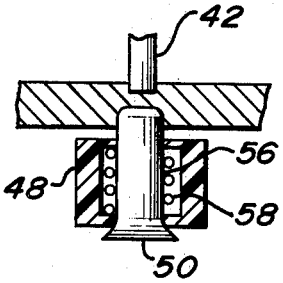
FIG. 10 is a fragmentary side elevational view, partly in section, of a portion of the locking means shown in FIG. 2.
Figure 11:
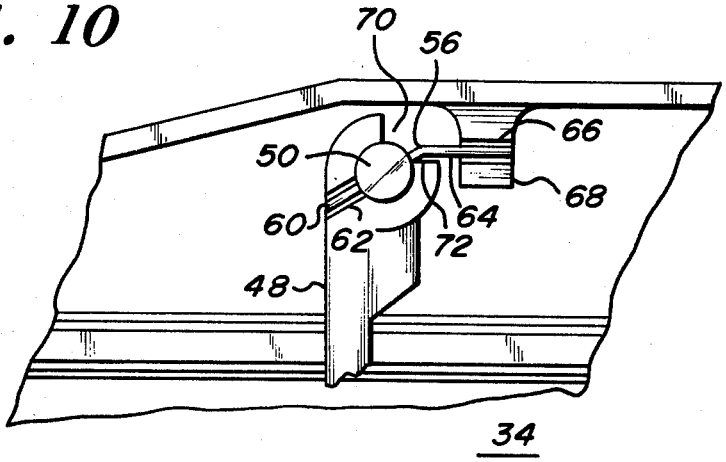
FIG. 11 is a fragmentary bottom plan view of a portion of the locking means shown in FIG. 2.

Referring now to FIGS. 2 through 11, there is shown a nose portion 34 of a strap applying tool similar to nose portion 20 but including a locking means 36 constructed in accordance with the concepts of the invention. The locking means 36 comprises a lock pin 38 shown as a straightened extended portion of a torsion spring 40 loosely wrapped about a support member 42 affixed to the nose portion 34 at 44. The other end of the torsion spring 40 indicated by the numeral 46 is attached to an actuator 48 which is pivotingly mounted on a post 50 attached to the nose portion 34. The actuator 48 is provided with a finger portion 51 selectively located in the nose portion 34 so as to intersect the path of the plunger 26, as may be more clearly seen in FIG. 5. Adjacent the lock pin 38 is an opening 52 in the nose portion 34 through which the lock pin 38 may be deployed for engagement with the jaw 22. The opening 52 is partially defined by an inclined surface 54 selectively positioned at an oblique angle with respect to the plane of movement of the lock pin 38 so as to provide both a camming and bearing surface therefore in a manner to be described in greater detail below. The actuator 48 is biased to a first or non-activated position as shown in FIG. 5 by a biasing means shown in FIGS. 10 and 11 as including a torsion spring 56 disposed within an annular recess 58 in the actuator 48, the spring 56 having a first end 60 lying in a slot 62 in the actuator, the other end 64 of the torsion spring 56 engaging a slot 66 in a gusset portion 68 of the nose portion 34. The periphery of the actuator 48 is provided with an opening 70 (FIG. 11) one end 72 of which is arranged to abut the end 64 of the spring 56 to restrict the rotational movement of the actuator 48 so as to orient the finger portion 51 thereof at the desired angle with respect to the path of travel of the plunger 26. At the beginning of the tool cycle, the actuator 48 is positioned substantially as shown in FIGS. 2 and 5 thereby positioning the lock pin 38 out of engagement with the jaw 22 and adjacent the opening 52. The opening 52 is so located in the nose portion 34 with respect to the jaw 22 so that an adjacent portion of the side surface of the jaw 22 extends across the opening 52 when the jaw 22 is in its first or open position, as shown in FIGS. 2 and 3. In this position, the plane of movement of the lock pin 38 extends through that portion of the jaw 22 visible through the opening 52. The respective positions of the jaw 22, the opening 52, and the lock pin 38 at the beginning of the cycle are clearly shown in FIGS. 3 and 4. As the operative cycle of the tool is initiated, the plunger 26 is caused to advance towards the actuator 48 in a direction indicated by the arrow 74 in FIGS. 5 and 7. In its advance, the actuator 26 first contacts the jaw 22, straightening out the articulated assembly comprising the jaw 22 and the member 28, and causing the jaw 22 to move towards its second or closed position substantially as shown in FIG. 8. If no obstruction is present to prevent the jaw 22 from advancing to its fully closed position, it will move downwardly across the opening 52 so that the portion thereof directly adjacent the opening 52 will assume a position with respect to the opening 52 substantially as shown in FIG. 6. The plunger 26 will continue to advance until it contacts the finger portion 51 of the actuator 48, as shown in FIG. 7, causing the actuator 48 to rotate about the post 50, thereby causing the torsion spring 40 and lock pin 38 to rotate in a direction shown by the arrow 76 in FIG. 6 in unison with the actuator 48 by virtue of the connection between the end 46 of the spring 40 and actuator 48. The lock pin 38 is thus caused to be deployed from its first or open position through the opening 52 to a second or lock position shown in FIGS. 6 and 8, wherein the lock pin 38 overlies the jaw 22. The inclined surface 54 of the opening 52 is arranged to correct any upward misadjustment of the lock pin 38 with respect to the opening 52 and to guide and hold the lock pin 38 into proper engagement with the top of the jaw 22. The jaw 22 is thus effectively locked against any further upward movement, the jaw biasing assembly consisting of the plunger 32 and the spring 33 thereby being rendered inoperative at this stage of the tool cycle. It will thus be appreciated that the upper inclined surface 54 of the opening 52 provides a solid bearing surface for the lock pin 38 to restrain the upward movement of the jaw 22 in the lock position. In the event the jaw 22 encounters an obstruction preventing its full closure during the advancing stroke of the plunger 26, the jaw 22 will assume some intermediate position between its fully open and fully closed position, substantially as shown in FIG. 9, thereby at least partially blocking the opening 52 so that the lock pin 38, upon its activation by the actuator 48, is caused to rotate into the opening 52 and contact the side of the jaw 22 without effecting the locking action described above. Consequently, the jaw biasing assembly including the plunger 32 and the spring 33 will continue to function as a relief device for the jaw 22. The stress exerted on the lock pin 38 by engagement with the side of the jaw 22 is transferred to the turns of the spring 40 so that the actuator 48 is free to rotate through its designated arc even though the movement of the lock pin 38 has been impeded.

The embodiments of the invention in which an exclusive property or privilege is claimed are defined as follows:

I claim:

1. In a tool of the type having a pair of jaws one of which is movable from a first or open position to a second or closed position, and plunger means for operating said movable jaw, said movable jaw being resiliently biased to prevent full closure thereof upon engagement with an obstruction between said jaws, the improvement comprising: locking means for releasably maintaining said movable jaw in a fully closed state upon movement of said movable jaw to said second position, said locking means including, a lock pin movable from a first position out of engagement with said movable jaw to a second position in which said lock pin engages said movable jaw, a support member operatively coupled to said lock pin, an opening in said tool for permitting said lock pin to be deployed to its said second position for engagement with said movable jaw, an actuator movably coupled to said tool, said actuator being engageable by said plunger means for moving said lock pin between its said first position and its said second position, and means selectively coupling said lock pin to said actuator to provide corresponding movement therebetween, said opening having a camming surface for maintaining said lock pin in engagement with said movable jaw against an opposing force tending to move said movable jaw from its said second position to its said first position.

2. The improvement as defined in claim 1 wherein said camming surface is inclined at an oblique angle to the plane of movement of said lock pin.

3. The improvement as defined in claim 1 wherein said means selectively coupling said lock pin to said actuator comprises a torsion spring.

4. The improvement as defined in claim 3 wherein said lock pin comprises a straightened extending portion of said torsion spring.

5. The improvement as defined in claim 3 wherein the end of said torsion spring opposite said straightened extending portion is fixedly attached to said actuator.

6. The improvement as defined in claim 1 wherein said actuator is pivotingly coupled to said tool.

7. The improvement as defined in claim 6 further comprising biasing means cooperative with said actuator for returning said actuator and said lock pin to said first position upon the retraction of said plunger means.

8. The improvement as defined in claim 7 wherein said biasing means comprises a torsion spring cooperative with said actuator and said tool.

9. The improvement as defined in claim 1 wherein said lock pin moves from said first position to said second position in a plane substantially normal to the plane of movement of said movable jaw.

10. The improvement as defined in claim 9 wherein said lock pin is located adjacent one side of said movable jaw when said lock pin and said movable jaw are both in their respective first position so that said one side of said movable jaw blocks the movement of said lock pin from its said first position to its said second position when said movable jaw has failed to move fully into its said second position.

* * * * *